United States Patent [19]

Kristen

[11] Patent Number: 4,941,310

[45] Date of Patent: Jul. 17, 1990

[54] APPARATUS FOR VACUUM SEALING PLASTIC BAGS

[75] Inventor: Hanns J. Kristen, San Anselmo, Calif.

[73] Assignee: Tillia Aktiengesellschaft, Vaduz, Fed. Rep. of Germany

[21] Appl. No.: 332,504

[22] Filed: Mar. 31, 1989

[51] Int. Cl.[5] ..... B65B 31/02

[52] U.S. Cl. ..... 53/512; 53/434

[58] Field of Search ..... 53/512, 510, 434, 432, 53/479, 373; 426/412, 410; 156/379.8, 379.6, 380.8

[56] References Cited

U.S. PATENT DOCUMENTS

| | | | |
|---|---|---|---|
| 2,778,171 | 1/1957 | Taunton | 53/9 |
| 3,516,223 | 6/1970 | Anderson et al. | 53/512 |
| 3,688,463 | 9/1972 | Titchenal | 53/22 B |
| 3,699,742 | 10/1972 | Giraudi | 53/512 |
| 3,928,938 | 12/1974 | Burrell | 53/22 B |
| 3,965,646 | 6/1976 | Hawkins | 53/112 B |
| 4,164,111 | 8/1979 | Bernardo | 53/434 |
| 4,330,975 | 5/1982 | Kakiuchi | 53/79 |
| 4,372,096 | 2/1983 | Baum | 53/88 |
| 4,541,224 | 9/1985 | Mugnai | 531/434 |
| 4,545,177 | 10/1985 | Day | 53/512 X |
| 4,561,925 | 12/1985 | Skerjanec et al. | 53/512 X |
| 4,578,928 | 4/1986 | Andre et al. | 53/512 |
| 4,581,764 | 4/1986 | Plock et al. | 383/101 |

*Primary Examiner*—James F. Coan

*Attorney, Agent, or Firm*—Phillips, Moore, Lempio & Finley

[57] ABSTRACT

An apparatus for vacuum sealing plastic bags of the type disclosed in applicant's U.S. Pat. No. 4,756,422 comprises a hood adapted to define a vacuum chamber when it is moved to a closed position on a support surface. An elastomeric seal, circumventing the vacuum chamber, is adapted to engage and statically seal outer surfaces of a bag. The seal isolates an open end of the bag and the vacuum chamber from ambient and maintains such open end in communication with an evacuative chamber of the bag. A vacuum system and sealer are provided for evacuating and heat sealing the bag. The hood can be pivotally mounted on a base or can be used as separate, self-contained unit adapted for placement on a support surface defined on a counter top or the like. The apparatus is further adapted for connection to a unique vacuum sealing attachment for a container whereby the container can be selectively evacuated.

38 Claims, 6 Drawing Sheets

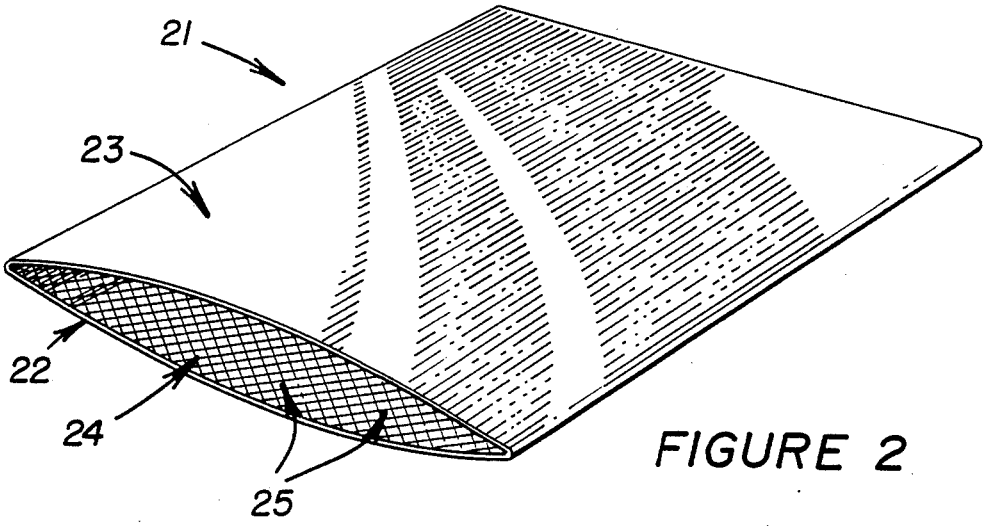
FIGURE 2
FIGURE 3
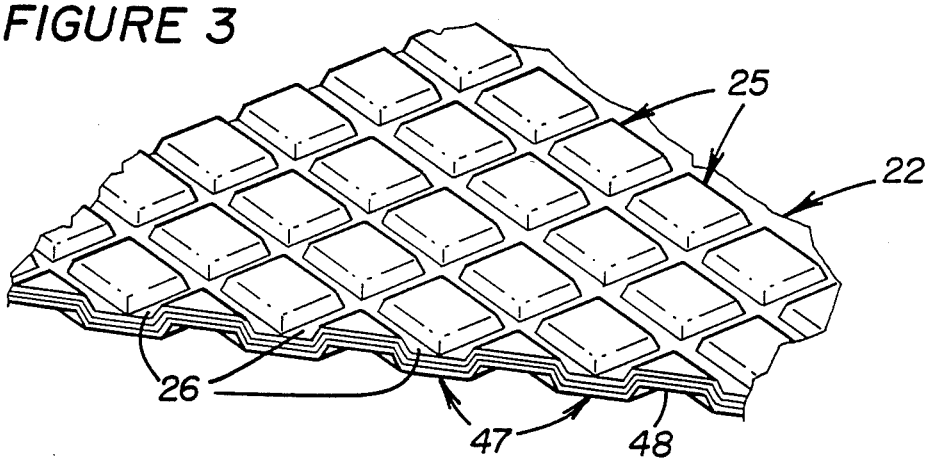
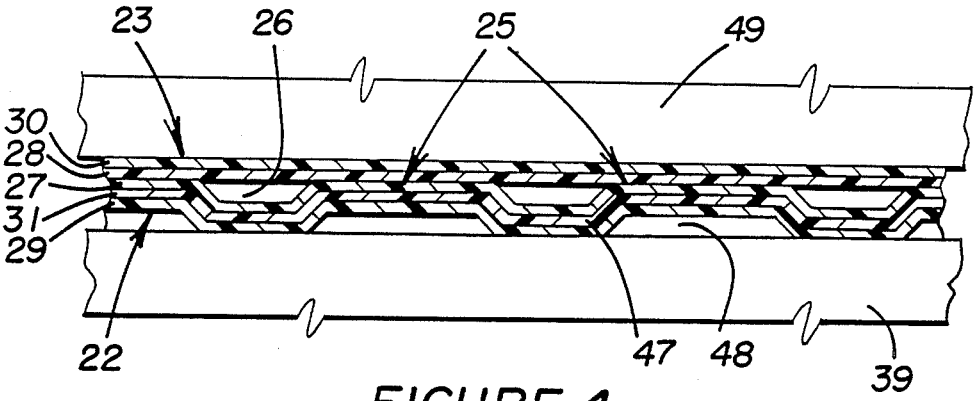
FIGURE 4

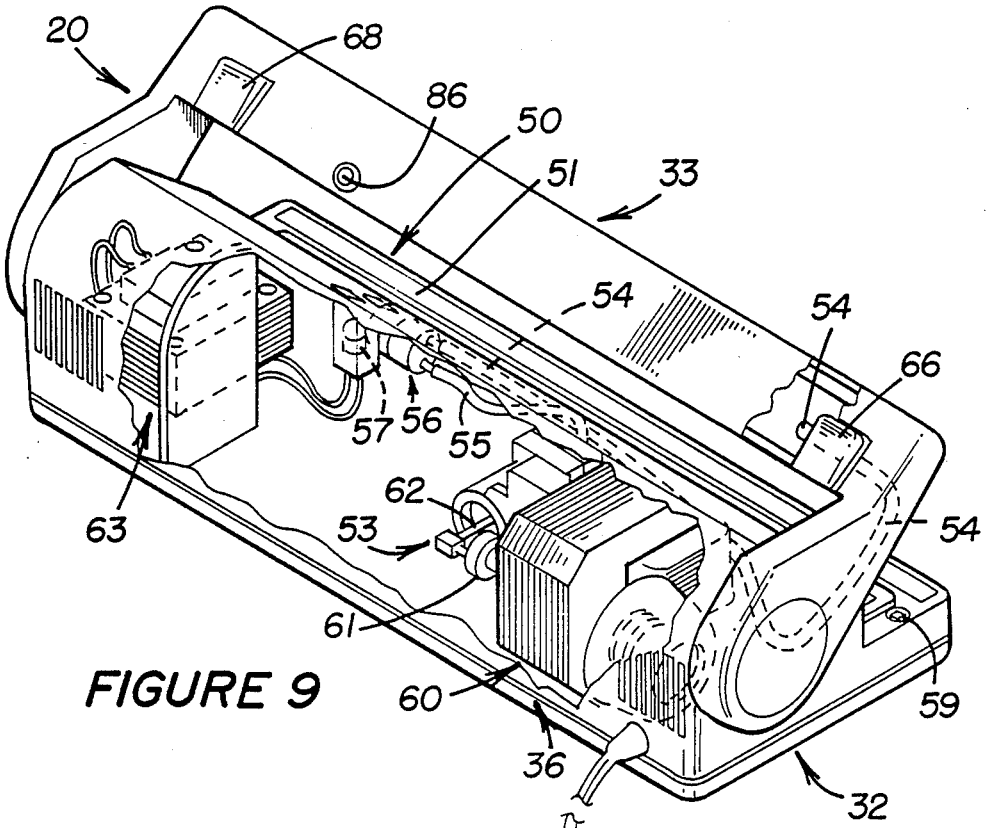
FIGURE 9
FIGURE 11
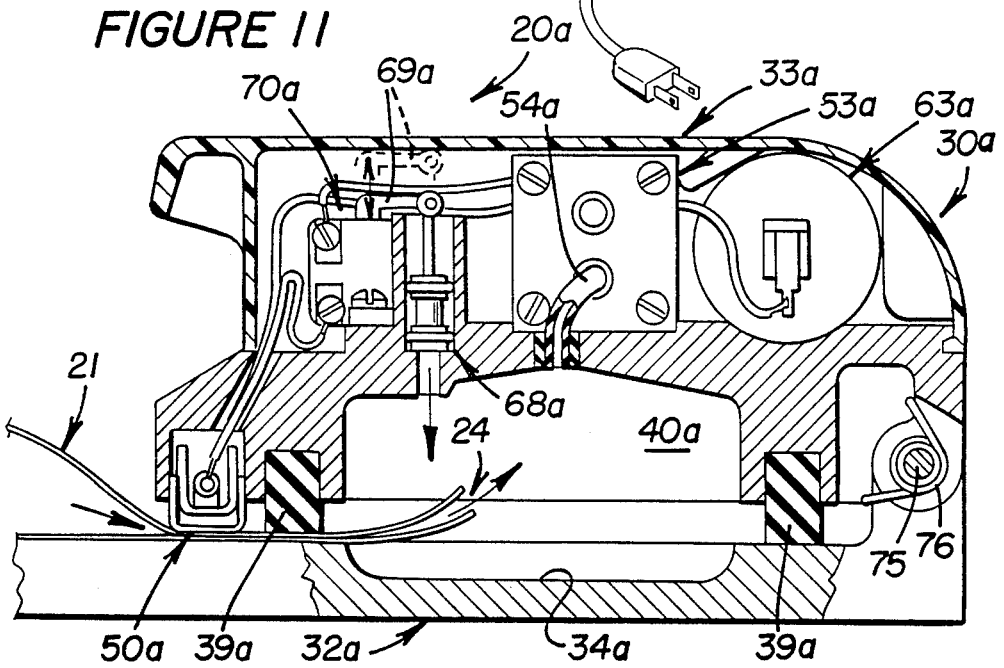

APPARATUS FOR VACUUM SEALING PLASTIC BAGS

TECHNICAL FIELD

This invention relates to an apparatus for packaging products and more particularly to an apparatus for vacuum sealing plastic bags.

BACKGROUND OF THE INVENTION

Various apparatus and methods are now used for the purpose of vacuum sealing plastic bags to protect perishables, such as foodstuffs, and other products against oxidation. Conventional apparatus are generally expensive to manufacture, complex in construction and cumbersome to operate. One conventional type of vacuum sealing system, primarily used for commercial packaging purposes, includes a vacuum chamber in which the entire packaged product is placed, along with heat sealers and attendant components of the system.

Another type of conventional vacuum sealing system uses a vacuum nozzle that is inserted within a plastic bag for evacuation purposes. Although adaptable for low-volume home use, the latter type of system is cumbersome to use and normally requires a liquid separator or filter to prevent liquids or powders, retained within the bag, from being drawn into a vacuum pump connected to the nozzle. Further, the heat sealer employed therein must be closely calibrated and synchronized with the positioning and withdrawal of the vacuum nozzle from the bag.

Still another type of conventional vacuum sealing system places a portion of a bag, containing a product to be packaged, in a first vacuum chamber and extends an open end or neck of the bag into a second vacuum chamber. The first vacuum chamber is then evacuated to expand the neck of the bag to isolate the chambers from each other whereafter a vacuum is drawn in the second vacuum chamber to evacuate the bag. Thus, isolation of the two chambers from each other, during evacuation of the second vacuum chamber, is critically dependent on the physical properties composing the neck of the bag (which is intended to form a static seal between the two chambers) and very close synchronization and calibration of the evacuation and sealing procedures and controls therefor. A vacuum sealing system of this type is disclosed in U.S. Pat. No. 3,928,938, for example.

U.S. Pat. No. 2,778,171 discloses another vacuum sealing system which, to applicant's knowledge, has not been commercialized. In particular, the open end of a plastic bag is placed between a pair of jaws (FIGS. 14–17) or between a lower jaw and a flexible sheet (FIGS. 18–20) to evacuate the bag which is then heat sealed. An inner surface of the bag has protuberances (FIGS. 1–4) formed on it which make point contact with an opposed surface of the bag to define air exhaust passages during evacuation.

SUMMARY OF THE INVENTION

An object of this invention is to provide a highly efficient, non-complex, economical and improved vacuum sealing apparatus that exhibits ease of operation.

The apparatus is adapted to vacuum seal a plastic bag having overlying first and second panels defining an evacuative chamber therebetween and overlying heat sealable panel portions terminating at an open end of the bag, communicating with the evacuative chamber. A plastic bag of this type is disclosed in applicant's U.S. Pat. No. 4,756,422.

The apparatus comprises a base defining an upper support surface adapted to receive the open end and sealable panel portions of the bag thereon, and a hood mounted on the base and movable to a closed position to position a frontal side thereof over the open end and sealable panel portions of the bag. The hood and base define a vacuum chamber therebetween adapted to receive the open end of the bag in exposed relationship therein. A static seal circumvents the vacuum chamber and is disposed between the base and hood for directly engaging outer surfaces of the sealable panel portions of the bag in response to movement of the hood to its closed position. The seal isolates the open end of the bag and the vacuum chamber from ambient and maintains the open end of the bag in communication with the evacuative chamber thereof. An evacuation system communicates with the vacuum chamber for evacuating the evacuative chamber of the bag and cooperates with the vacuum chamber to prevent liquids and powders from entering a pump of such evacuation means. A heat sealer, mounted forwardly on one of the base and hood, forms an air-tight seal across the sealable panel portions of the bag to maintain the vacuum within the evacuative chamber of the bag.

In another aspect of this invention, the working components of a self-contained apparatus are mounted in a hood. The hood is adapted for mounting on a base or can be used indepently, such as by placing it on a support surface defined on a counter top or the like.

In still another aspect of this invention, a vacuum sealing attachment is provided for attachment to a container. The vacuum sealing attachment communicates with the vacuum chamber of the apparatus whereby the apparatus can be further utilized to evacuate the container.

BRIEF DESCRIPTION OF THE DRAWINGS

Other objects and advantages of this invention will become apparent from the following description and accompanying drawings wherein:

FIG. 2 is an isometric view of a preferred embodiment of the plastic bag;

FIG. 3 is an enlarged isometric view partially illustrating an inner surface of one of the panels of the plastic bag, including a plurality of raised protuberances and intercommunicating channels formed thereon;

FIG. 4 is an enlarged sectional view illustrating overlying panel portions of the bag as they would appear between a pair of elastomeric seals during a vacuum sealing operation;

FIG. 9 is a backside isometric view of the apparatus with its hood and base broken-away to expose working components of the vacuum and heat sealing systems of the apparatus;

FIG. 11 is a transverse cross-sectional view illustrating a second embodiment of the vacuum sealing apparatus;

DESCRIPTION OF THE PREFERRED EMBODIMENT(S)

General Description

Figure 1:
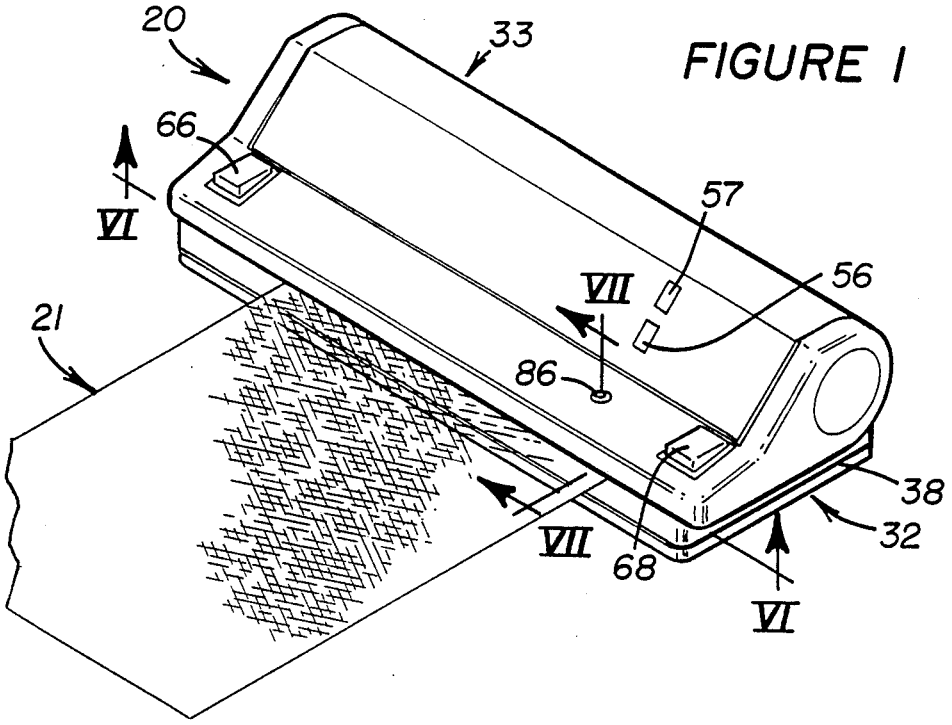
FIG. 1 is an isometric view illustrating a vacuum sealing apparatus of this invention as it would appear during the vacuum sealing of a plastic bag of the type disclosed in applicant's U.S. Pat. No. 4,756,422.

FIG. 1 illustrates a vacuum sealing apparatus 20 for evacuating and then sealing a plastic bag 21, preferably of the type shown in FIGS. 2–4 and fully described in applicant's U.S. Pat. No. 4,756,422. In particular, the bag comprises overlying first and second panels 22 and 23, respectively, closed on three sides to define an open end 24 at overlying heat sealable panel portions thereof, adapted to facilitate insertion of a food or other packaged product therein. The bag can be either formed from a seamless tube or by overlying, separate sheets, as is well-known to those skilled in the packaging arts. As shown in FIGS. 2 and 3, a plurality of raised protuberances 25 are formed in a generally regular and waffle-like pattern on the inner surface of panel 22. The protuberances project outwardly from panel 22, towards the inner surface of panel 23, to define a plurality of intercommunicating air-exhausting channels 26 entirely around and between the protuberances.

Although shown formed on the inner surface of panel 22, such protuberances and channels could be formed on the inner surface of panel 23 or on the inner surfaces of both panels. Referring to FIG. 4, showing overlying panel portions of the bag sealed from ambient but with channels 26 remaining open, each panel has a uniform thickness, including the thickness of each protuberance 25 on panel 22. Each inner layer 27 and 28 of the panels is preferably entirely composed of a heat-sealable material, such as polyethylene or polypropylene. Each outer layer 29 and 30 of the panels is preferably entirely composed of a gas impermeable material, such as polyester or Nylon.

As further shown in FIGS. 2 and 3, the panel having protuberances 26 formed thereon (panel 22 for this embodiment of the bag) may further comprise an intermediate layer 31 suitably bonded between inner and outer layers 27 and 29 to provided added stiffness to this panel to aid in preventing "collapse" of the bag under full vacuum. In particular, the intermediate layer will exhibit a stiffness greater than each of the inner and outer layers and may be composed of a high density polyethylene, for example. In one bag embodiment of this invention, the inner, outer and intermediate layers were formed with thicknesses of about 0.5–1.0 mil, 1.5 mil, and 0.5 mil, respectively.

Figure 6:
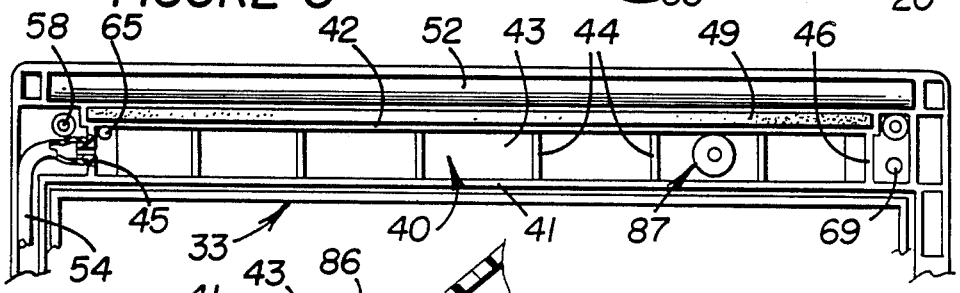
FIG. 6 is a bottom plan view of a hood of the apparatus, taken in the direction of arrows VI—VI in FIG. 1.
Figure 7:
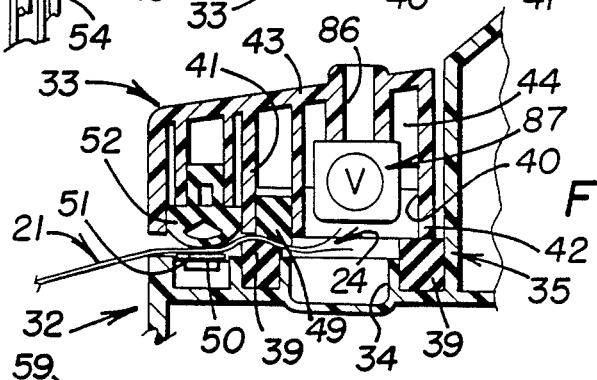
FIG. 7 is a transverse cross-sectional view through the apparatus, taken in the direction of arrows VII—VII in FIG. 1, showing the hood in a closed position during a vacuum sealing operation.
Figure 8:
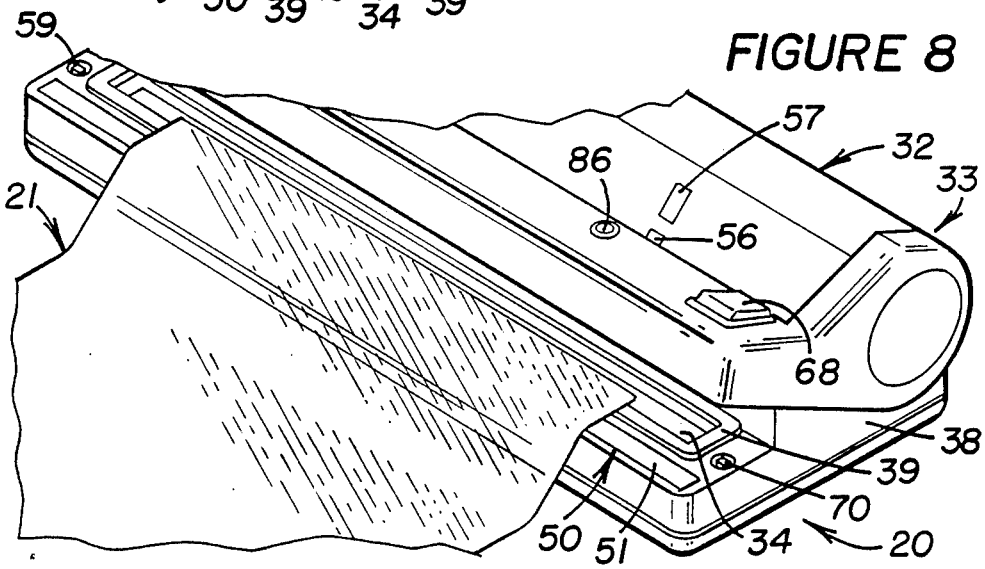
FIG. 8 is a partial frontal isometric view of the apparatus, showing its hood in a partially open position.

Referring to FIGS. 1 and 5–9, apparatus 20 is adapted to evacuate bag 21 and then seal overlying panels 22 and 23 of the bag together. The panels define an evacuative chamber therebetween adapted to retain a packaged product. As described above, the bag defines overlying heat sealable panel portions terminating at an open end 24 of the bag, communicating with the chamber. The apparatus comprises a base 32 defining an upper support surface thereon adapted to receive the open end and sealable panel portions of the bag thereon (FIG. 8).

A hood 33 is pivotally mounted on the base and moveable to a closed position (FIGS. 1 and 7) to position a frontal side of the hood over the open end and sealable panel portions of the bag. The base defines a first chamber portion or trough 34 of a composite vacuum chamber adapted to receive the open end of the bag in exposed relationship thereto. The trough also functions to collect liquids and powder particles that are exhausted from the bag to prevent their ingress into a vacuum pump 53, described more fully hereinafter. As further described hereinafter, a static sealing means 35 circumvents and seals the vacuum chamber and directly engages outer surfaces of the sealable panel portions of the bag (FIGS. 4 and 7) in response to movement of the hood to its closed position.

The sealing means thus forms a static seal isolating the open end of the bag and the vacuum chamber from ambient and maintains the open end of the bag in communication with the evacuative chamber of the bag, via open channels 26, in the manner described above (FIG. 4). An evacuation system (FIG. 10) is provided to communicate with the vacuum chamber to selectively evacuate the bag. The drawing of a vacuum in the chamber will create a differential pressure on opposite sides of hood 33 to draw the hood towards base 32, aiding in the sealing function. A heat sealing system is also provided for forming an air-tight heat seal across the sealable panel portions of the bag to maintain the vacuum within the evacuative chamber of the bag for product storage purposes.

Detail Description

As shown in FIGS. 1 and 7–9, base 32 comprises a moldable plastic housing 38 suitably constructed to retain various working components of the apparatus therein. Vacuum chamber portion or trough 34 is defined on a frontal side of the base to extend substantially the full length thereof. When a vacuum is drawn in the processed bag, liquid droplets or powdered particles will drop into the trough to prevent damage to a vacuum pump. Sealing means 35 comprises a continuous elastomeric seal 39 suitably secured on the base to completely circumvent trough 34.

As shown in FIGS. 6 and 7, the composite vacuum chamber further comprises a second chamber portion 40 defined in hood 33 to overlie trough 34. Chamber portion 40 is defined by a pair of longitudinally extending and parallel side walls 41 and 42 and a top wall 43 of the hood. Side walls 41 and 42, as well as the top wall, are reinforced by transversely extending and longitudinally spaced cross-struts 44 formed integrally with plastic molded hood 33.

Intermediate struts 44 are recessed within chamber portion 40 (FIG. 7) whereas the bottom edges of a pair of end struts 45 and 46 (FIG. 6) lie in the same flat plane at the bottom edges of side walls 41 and 42. Thus, when the hood is in its closed position, the bottom edges of side walls 41 and 42 (preferably aided by an optional seal 49) and end struts 45 and 46 will compress bag 21 against the entire upper surface of seal 39 in circumventing relationship about the vacuum chamber to form a static seal isolating the open end of the bag and the vacuum chamber from ambient (FIG. 7).

As shown in FIG. 4, when the hood compresses against upper panel 23 of the bag to form a static seal thereat, intercommunicating channels 26 will remain open for evacuation purposes. Interconnected and raised ridges 47 are formed on the outer side of panel 22 to define a plurality of non-intercommunicating, closed cavities 48 between the ridges. Thus, when the ridges are compressed against seal 39, the vacuum chamber will be completely isolated from ambient. In the preferred embodiment of this invention, sealing means 35 further includes an additional elongated elastomeric seal 49, suitably secured on the underside of hood 33 to fully overlie the frontal portion of seal 39 (FIGS. 6 and 7).

As shown in FIGS. 7–9, a heat sealing means comprises a low voltage heating element 50 suitably secured forwardly on base 32 and a step-down transformer 63 (FIGS. 9 and 10) for stepping down the voltage from 115 v. to 12–18 v. A light 57 is mounted on the hood to indicate heat sealing. The heating element extends substantially the full length of the base and past the ends of the vacuum chamber to insure full sealing across the full width of the bag, draped over the heating element.

If so desired, a Teflon (polytetrafluroethylene) tape 51 can be suitably secured over the heating element to insure non-adherence of the bag thereto. A longitudinally extending elastomeric pressure profile 52 is suitably secured on a frontal and underside of hood 33 (FIGS. 6 and 7) to insure application of adequate pressure of the bag over the heating element and full sealing of heat sealable layers 27,28 together via heat conduction through layers 29 and 31. (FIG. 4).

Figure 10:
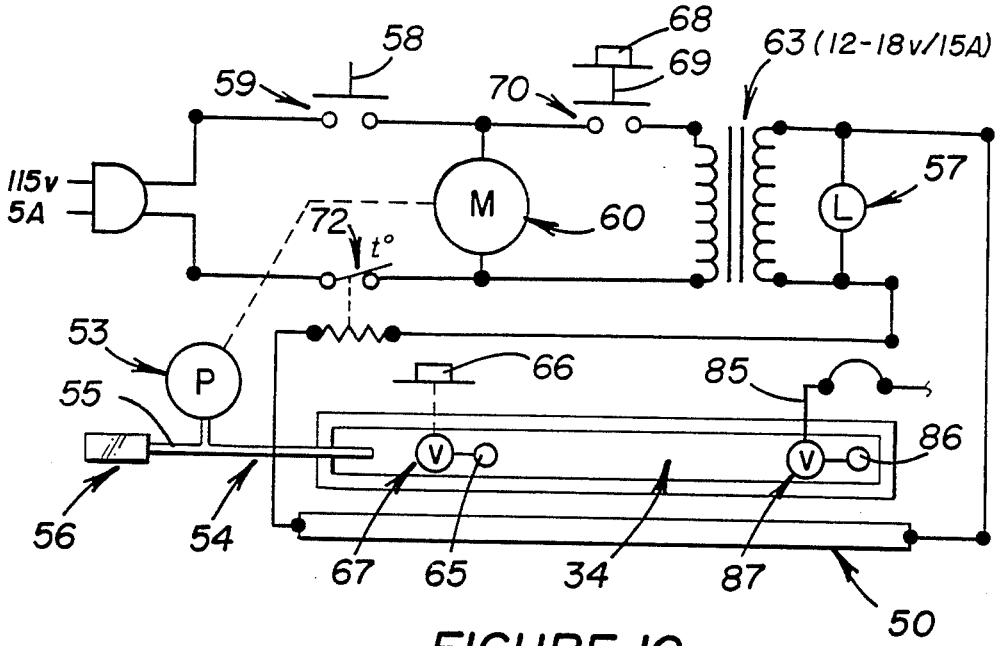
FIG. 10 is a schematic circuit diagram, illustrating vacuum and sealing controls employed in the apparatus.
Figure 5:
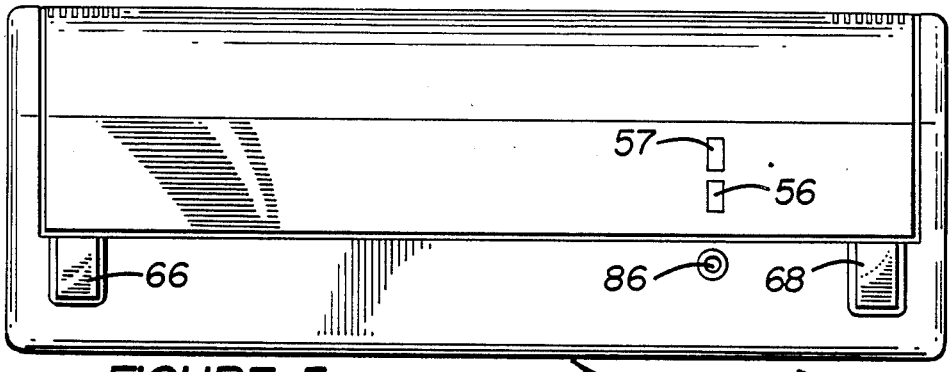
FIG. 5 is a top plan view of the apparatus.

Referring to FIGS. 9 and 10, the evacuation system further comprises a standard vacuum pump 53 communicating with the vacuum chamber via a plastic tube 54. A second tube 55 (FIGS. 9 and 10) is interconnected between the vacuum pump and a vacuum indicator 56. An elongated pin 58, suitably molded beneath hood 33 (FIG. 6), is positioned over a normally open electrical switch 59, mounted in base 32, whereby closing of the hood will engage the pin with the switch to close the switch to activate a motor 60 connected to pump 53 (FIG. 10).

As shown in FIG. 9, the rotating output shaft of the motor is suitably connected to an eccentric 61 to reciprocate a piston rod 62 of the standard pump in response to rotation of the eccentric. Since evacuation pumps and drive mechanisms of this type are well known in the art, further detailed description thereof is deemed unnecessary for a full understanding of this invention. The capacity of the pump may be in the range of 1.7 CFM.

A vent hole 65 (FIGS. 6 and 10) is formed through hood 33 to normally vent the vacuum chamber to ambient. When the hood is closed to initiate a vacuum operation via closed switch 59, the operator will then depress a button 66 to close a normally open poppet valve 67 and thus close vent hole 65. The vacuum is then drawn in the vacuum chamber and within the evacuative chamber of the processed bag with vacuum indicator 56 indicating that the vacuum chamber is being evacuated with a full static seal being maintained across the bag by the above described sealing means.

After the bag has been fully evacuated, a second button 68 is depressed on the opposite end of the hood to energize heating element 50 (FIG. 10). The standard button-switch is normally spring-biased to its raised and open position and has an elongated pin 69 (FIG. 6) secured thereunder. The pin is reciprocally mounted in the hood to engage and close a switch 70 (FIGS. 8 and 10) mounted on base 32. The switch is suitably connected to transformer 63 to electrically energize the heating element to its pre-designed temperative level whereby the bag will be fully sealed. A suitably selected amperometric thermo cut-out switch 72 interrupts the power supply to the apparatus upon completion of the seal. Light 57 is mounted on the hood to display energization of heating element 50.

The electrical and pneumatic control circuits for the apparatus can further include various additional standard control devices, well known to those skilled in the art, to enhance the versatility and ease of operation of the apparatus. For example, the circuits can further include a standard electronic adjustable sealer timer to replace amperometric thermo cut-out switch 72, an electrically actuated valve in parallel with pump motor 60 connecting the vacuum side of pump 53 to atmospheric to replace the valve 67, an opening in base 32 and an electrically actuated poppet valve to replace valve 87, a pair of standard thermo-protectors for pump motor 60 and transformer 63, a vacuum actuated adjustable microswitch for automatic heat sealing to replace switch 70 or in parallel with switch 70, a double pump and a vacuum activiated valve switching the pumps from parallel to serial at a pre-determined vacuum to increase speed of evacuation and maximum achievable vacuum, an electrically or vacuum activated mechanism to lower hood 33, and/or a remote (foot) control, electric or pneumatic, for hands-off operation.

FIG. 11 illustrates a modified and self-contained vacuum sealing apparatus 20*a* wherein identical numerals depict corresponding components and constructions, but with numerals appearing in FIG. 11 being accompanied by an "a." Apparatus 20*a* is elongated to generally take the form of apparatus 20 (FIG. 1). Apparatus 20*a* comprises a hood 33*a* that contains working components of the apparatus.

The hood is pivotally mounted on a base 32*a* by a pair of longitudinally spaced pins 75 (one shown) with a torsion spring 76 being mounted on each pin to normally bias the hood to its open position. A similar arrangement could be use to pivotally mount hood 33 on base 32 of apparatus 20. The hood can be detached from the base and used as an independent unit for vacuum sealing bags, such as by placing it on a counter top, table or the like that would provide a suitable support surface therefor.

The vacuum chamber defined between the hood and the base comprises a first chamber portion or trough 34*a* defined in the base and a second chamber portion 40*a* defined in the hood to overlie trough 34*a*. A continuous elastomeric seal 39*a*, similar to seal 39, is secured underside of the hood to extend entirely about the periphery of the vacuum chamber. The seal is adapted to directly engage flat and uninterrupted upper surface portions of base 32*a* (or the flat surface of a counter top or the like when the hood is used as an independent unit) to isolate open end 24 of bag 21 and the vacuum chamber from ambient. A vacuum pump 53*a* of the type described above, communicates with a tube 54*a* having its open end exposed to the vacuum chamber to draw a vacuum therein. The drawing of a vacuum in the chamber will create a differential pressure on opposite sides of the hood to aid in the static sealing of the chamber and bag 21.

After the bag has been evacuated, an electrically energized heating element 50*a*, mounted beneath the frontal side of the hood, is activated to form a heat seal entirely across the open end of the bag. After the bag has been evacuated, a standard vacuum responsive plunger 68a is drawn downwardly to its position illustrated in FIG. 11 to close a normally open switch 70a via a reciprocal switch actuating member or arm 69a. Closing of the switch will energize the heating element in much the same manner as described above.

The control circuit for apparatus 20a may be generally of the type illustrated in FIG. 10, including utilization of vacuum indicator 56 and light 57. The self-contained apparatus includes the appropriate number of standard rechargeable (12 v. DC and/or 115 v. AC) NiCad batteries 63a and associated standard circuitry to provide the power source for the vacuum pump and heat sealer. Apparatus 20a is adapted to be wall-mounted and is further adapted as a portable self-contained unit for use in recreational environments and the like.

FIGS. 12–19 illustrate a lid attachment 77 for a container 78 adapted for connection to the vacuum chamber of apparatus 20 for the purpose of selectively evacuating the container. The lid attachment comprises an annular lid adapter 79 and an annular elastomeric seal 80 secured thereunder to form a static seal at an upper flange 81 of container 78. The lid attachment further comprises an annular connector 82 having an annular elastomeric seal 83 secured thereunder to engage a radially outer surface of an annular ridge 84 formed on lid adapter 79.

Figure 12:
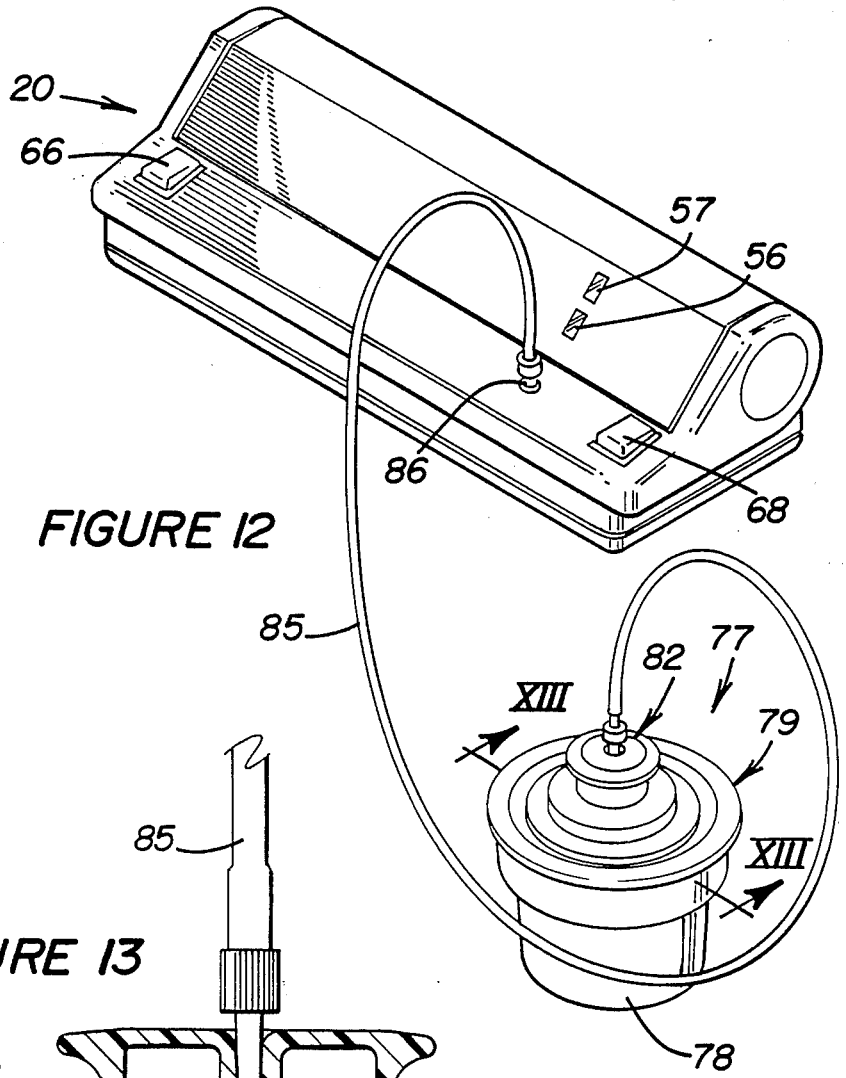
FIG. 12 illustrates connection of the FIG. 1 apparatus to a lid attachment for evacuating a container.
Figure 13:
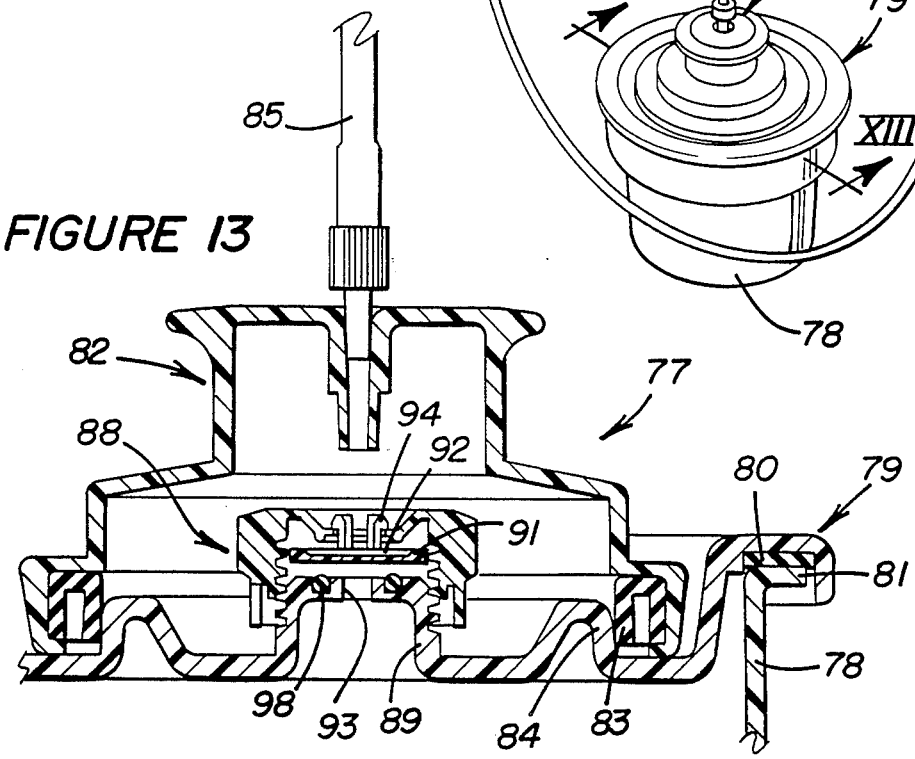
FIG. 13 is an enlarged cross-sectional view through the lid attachment, taken in the direction of arrows XIII—XIII in FIG. 12.
Figure 15:
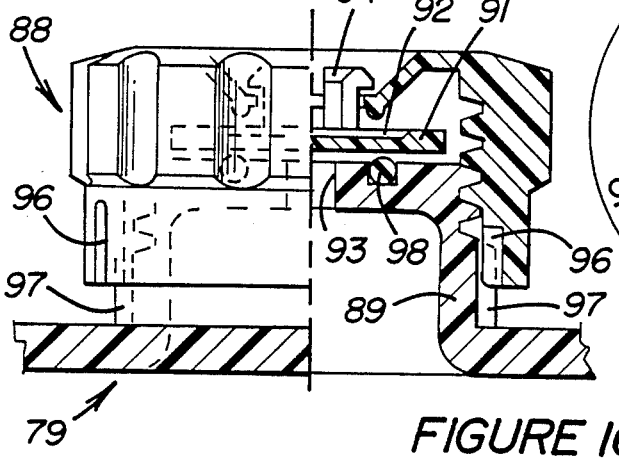
FIGS. 14–19 sequentially illustrate three rotative positions of a thumb nut for the lid attachment.

A flexible plastic tube 85 is attached between connector 82 and an opening 86, formed through the top panel of hood 33 (FIG. 12). As schematically illustrated in FIG. 10, a normally closed standard poppet valve 87 is opened when a standard fitting, secured to an end of tube 85, is depressed within opening 86. The mounting of the valve on the hood is further shown in FIG. 6.

Referring to FIGS. 14–19, a thumb-nut 88 is threaded onto a neck 89, formed centrally on lid adapter 79. As illustrated, an indicia marking in the form of an arrow 90 is formed on the thumb-nut to visually indicate one of three operative positions of the thumb-nut, i.e., "vacuum", "closed", or "open" as marked on lid adapter 79. When the thumb-nut is rotated to its "vacuum" position illustrated in FIGS. 14 and 15, a user is enabled to close hood 33 on base 33 of apparatus 20 and press button 66 to draw a vacuum in container 78.

In particular, a plastic disc 91 is "loosely" mounted within thumb-nut 88 and forms a valve element that openly communicates the vacuum drawn in tube 85 (FIGS. 12 and 13) with the container. The vacuum is drawn across a transverse slot 92 formed in the upper surface of the disc and through a centrally disposed passage 93, formed through neck 89. The applied vacuum will induce a lifting of disc 91, which overlies passage 93, to aid in expeditious evacuation.

A plurality of radially and circumferentially spaced hook-like fingers or retention members 94 are formed integrally with the disc in upstanding relationship thereon to extend through a mounting hole and overlie a flange 95 defined on the thumb-nut for retention purposes. The retention members are sufficiently flexible and resilient to permit a snapping-out of the members from their mounting hole, formed centrally through the thumb-nut. It should be noted in FIG. 15 that a flexible detent 96 is formed integrally on a side wall or skirt of the thumb nut to extend radially inwardly to releasably engage within a groove 97, formed on the outer side of neck 89.

Figure 14:
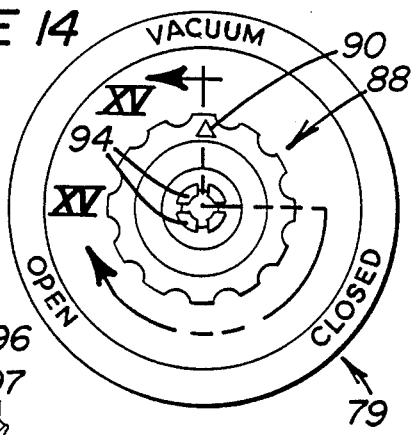

This detent arrangement will releasably retain the thumb nut is in its illustrated "vacuum" position in FIG. 14. A similar detent arrangement is also provided for releasably holding the thumb screw in each of its "closed" (FIGS. 16 and 17) and "open" (FIGS. 18 and 19) positions. Otherwise stated, three circumferentially spaced (120° apart) detents 96 and their associated grooves 97 are formed on the thumb screw and neck for this purpose. It should be noted that during evacuation of contain 78 that the large chamber and reservoir defined between lid adapter 79 and connector 82 will collect and prevent liquids and powders, drawn from the container, from entering tube 85.

Figure 16:
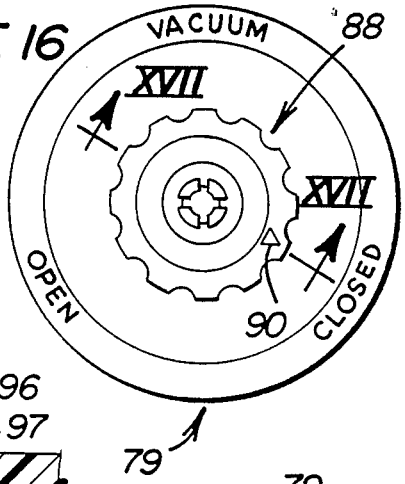
Figure 17:
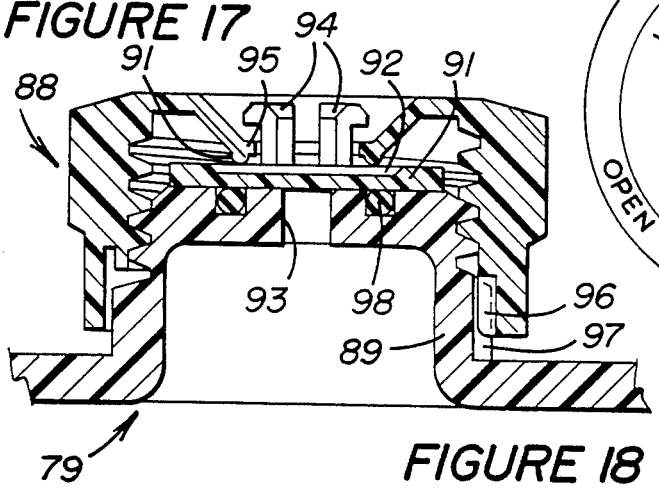

After the container has been evacuated, connector 82 is removed and thumb nut 88 is turned-down to its "closed" position illustrated in FIGS. 16 and 17 to compress the flat underside of disc 91 against an O-ring seal 98, mounted on neck 89 to surround passage 93. When the connector is removed, the vacuum in the container will pull disc against seal 98 to retain the vacuum until the thumb-nut is turned-down. An annular bead 99 is formed beneath flange 95 of the thumb nut to engage the upper side of disc 91 to compress it against the seal. Diametrically extending and narrow slot 92 will not interfere with this closing function.

Figure 18:
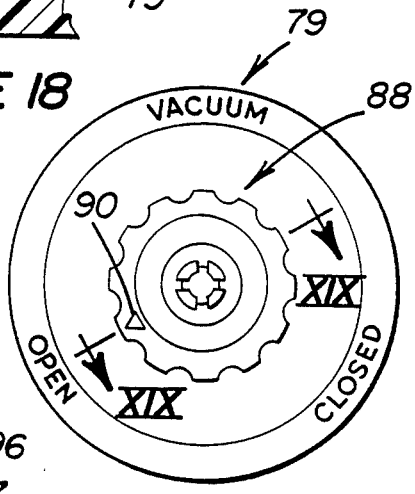
Figure 19:
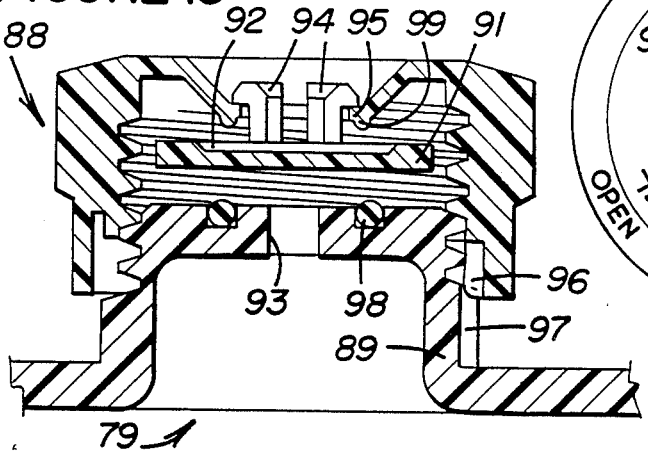

When the user chooses to release the vacuum in the container, thumb nut 88 is released to its FIGS. 18 and 19 position whereby flange 95 will engage beneath the hook ends of retention members 94 to raise disc 91 from seal 98. Air is thus permitted to ingress into the container via slot 92 and passage 93.

I claim:

1. An apparatus for vacuum sealing a plastic bag having overlying first and second panels defining an evacuative chamber and overlying heat sealable panel portions terminating at an open end of said bag communicating with said evacuative chamber, said apparatus comprising a base defining an upper support surface adapted to receive the open end and sealable panel portions of said bag thereon, a hood mounted on said base and movable to a closed position to position a frontal side thereof over the open end and sealable panel portions of said bag, said hood and base defining a vacuum chamber means therebetween having a width extending from a frontal side of said apparatus that is sized to only receive the open end of said bag in exposed relationship therein and to position remaining portions of said bag exteriorly of said apparatus, static seal means circumventing said vacuum chamber means and disposed between said base and said hood for directly engaging outer surfaces of the sealable panel portions of said bag in response to movement of said hood to its closed position to form a static seal isolating only the open end of said bag and said vacuum chamber means from ambient and to maintain the open end of said bag in communication with the evacuative chamber thereof, evacuation means communicating with said vacuum chamber means for selectively evacuating said vacuum chamber means and the evacuative chamber of said bag, and heat sealing means, including a heating element mounted forwardly on one of said base and said hood, for selectively forming an air-tight heat seal across the sealable panel portions of said bag to maintain said vacuum within the evacuative chamber of said bag.

2. The apparatus of claim 1 wherein said hood is pivotally mounted on said base.

3. The apparatus of claim 1 wherein said vacuum chamber means comprises trough means defined on said base for collecting liquids and particles therein during vacuum sealing of said bag.

4. The apparatus of claim 3 wherein said vacuum chamber means further comprises a chamber portion defined in an underside of said hood to overlie said trough means.

5. The apparatus of claim 4 wherein said evacuation means comprises a tube having its distal end mounted in said hood in communication with the chamber portion of said vacuum chamber.

6. The apparatus of claim 3 wherein said static seal means comprises a continuous elastomeric seal secured on said base to completely circumvent said through means.

7. The apparatus of claim 6 wherein said static seal means further comprises a plurality of walls formed on an underside of said hood to overlie and have bottom edges thereof engage and compress against said elastomeric seal to form a static seal around said vacuum chamber means when said hood is moved to its closed position on said base.

8. The apparatus of claim 7 wherein said static seal means further comprises an elongated elastomeric seal secured on the underside of said hood to overlie and engage a frontal portion of said first-mentioned elastomeric seal when said hood is moved to its closed position on said base.

9. The apparatus of claim 1 wherein said static seal means comprises a continuous elastomeric seal secured on an underside of said hood to extend about the periphery of said vacuum chamber means and to engage an upper surface of said base to form a static seal thereat when said hood is moved to its closed position on said base.

10. The apparatus of claim 1 further comprising vent means for normally venting said vacuum chamber means to ambient and closing means for selectively closing said vent means to isolate said vacuum chamber means from ambient.

11. The apparatus of claim 10 wherein said vent means comprises a normally open poppet valve mounted on said hood and means mounted on said hood for selectively closing said poppet valve.

12. The apparatus of claim 10 wherein said evacuation means comprises vacuum pump means for selectively drawing a vacuum in said vacuum chamber means, tube means for communicating said vacuum pump means with said vacuum chamber means and control means for activating said vacuum pump means in response to movement of said hood to its closed position on said base.

13. The apparatus of claim 12 wherein said control means comprises a normally open switch mounted on said base and a pin means secured on an underside of said cover for engaging and closing said switch when said hood is moved to its closed position on said base.

14. The apparatus of claim 10 wherein said heat sealing means further comprises an electrical power source and switch means for selectively connecting said power source to said heating element.

15. The apparatus of claim 14 wherein said switch means comprises a normally open switch mounted on said base and means mounted on said hood for closing said switch means when said hood is in its closed position on said base.

16. The apparatus of claim 1 wherein said heating element is mounted forwardly of said static sealing means on said base.

17. The apparatus of claim 1 wherein said heating element is mounted forwardly of said static sealing means on said hood.

18. The apparatus of claim 1 further comprising lid attachment means for attachment to a container, and connection means interconnected between the vacuum chamber means of said apparatus and said lid attachment for selectively drawing a vacuum through said lid attachment and from within said container in response to activation of said evacuation means 19. The apparatus of claim 18 wherein said lid attachment means comprises a lid adapter having a passage formed therethrough and first sealing means secured thereunder for forming a static seal when it is mounted on said container, a connector, second sealing means for forming a static seal between said lid adapter and said connector when said connector is mounted on said lid adapter, and means mounted on said lid adapter for movement between a first position openly communicating said passage with said container, a second position for forming a third sealing means closing said passage to seal said container and a third position for opening said passage to communicate said container with ambient to release the vacuum therein.

20. An apparatus for vacuum sealing a plastic bag having overlying first and second panels defining an evacuative chamber and overlying heat sealable panel portions terminating at an open end of said bag communicating with said evacuative chamber, said apparatus comprising a hood movable to a closed position on a support surface to position a frontal side thereof over the open end and sealable panel portions of said bag, said hood at least in part defining a vacuum chamber means having a width extending from a frontal side of said hood that is sized to only receive the open end of said bag in exposed relationship therein and to position remaining portions of said bag exteriorly of said apparatus, static seal means mounted beneath said hood and circumventing said vacuum chamber means for directly engaging outer surfaces of the sealable panel portions of said bag in response to movement of said hood to its closed position to form a static seal isolating the open end of said bag and said vacuum chamber means from ambient and to maintain the open end of said bag in communication with the evacuative chamber thereof, evacuation means communicating with said vacuum chamber means for selectively evacuating said vacuum chamber means and the evacuative chamber of said bag, and heat sealing means, including a heating element mounted forwardly on and beneath said hood, for selectively forming an air-tight heat seal across the sealable panel portions of said bag to maintain said vacuum within the evacuative chamber of said bag.

21. The apparatus of claim 20 wherein said evacuation means comprises a tube having its distal end mounted in said hood in communication with said vacuum chamber means.

22. The apparatus of claim 20 wherein said static seal means comprises a continuous elastomeric seal secured on an underside of said hood to extend about the periphery of said vacuum chamber means and to engage said support surface to form a static seal thereat when said hood is moved to its closed position on said support surface.

23. The apparatus of claim 20 wherein said heating element is mounted forwardly of said static sealing means on said hood.

24. A lid attachment adapted for connection between a vacuum apparatus and a container adapted to have a vacuum drawn therein comprising a lid adapter, having a passage formed therethrough, first seal means secured under said lid adapter for mounting on said container to form a first static seal therebetween, a connector removably mounted on said lid adapter and having connection means thereon for connecting said lid attachment to said vacuum apparatus for selectively drawing a vacuum through said connection means, second seal means between said lid adapter and said connector to form a second static seal thereat, and control means mounted on said lid adapter for movement between: (1) a first position for openly communicating a vacuum from said connection means, through said connector and said passage and to said container; (2) a second position for closing said passage to fully seal said container; and (3) a third position for opening said passage to communicate said container with ambient to release the vacuum therein.

25. The lid attachment of claim 24 wherein said connection means comprises a flexible tube releasably attached to said connector.

26. The lid attachment of claim 24 wherein said control means comprises a thumb nut threadably mounted on said lid adapter for rotation between said first, second and third positions.

27. The lid attachment of claim 26 further comprising indicia means for visually indicating each of the first, second and third rotative positions of said thumb nut.

28. The lid attachment of claim 26 wherein said control means further comprises a valve element mounted in said thumb nut to overlie said passage.

29. The lid attachment of claim 28 further comprising third seal means mounted on said lid adapter to surround said passage and annular bead means on said thumb nut for engaging and compressing said valve element against said third seal means to close and seal said passage when said thumb nut is in its second position.

30. The lid attachment of claim 29 wherein said thumb nut has an annular flange thereon having said annular bead means formed thereunder and a plurality of hook-like flexible fingers formed integrally with said valve element to extend through a mounting hole formed through said thumb nut to overlie said flange whereby release of said thumb nut to its third position will engage said flange beneath said fingers to raise said valve element from said third seal means.

31. The lid attachment of claim 26 further comprising detent means for releasably retaining said thumb nut in each of its first, second and third positions.

32. The lid attachment of claim 31 wherein said detent means comprises three circumferentially spaced flexible detents formed integrally on a side wall of said thumb nut and three circumferentially spaced grooves formed on said lid adapter, each adapted to receive a respective one of said detents therein.

33. The lid attachment of claim 24 further comprising means defining a chamber between said lid adapter and said connector for collecting liquids and/or powders exhausted from said container when said control means is in its first position.

34. An apparatus for vacuum sealing a plastic bag having overlying first and second panels defining an evacuative chamber and overlying heat sealable panel portions terminating at an open end of said bag communicating with said evacuative chamber, said apparatus comprising a base defining an upper support surface adapted to receive the open end and sealable panel portions of said bag thereon, a hood mounted on said base and movable to a closed position to position a frontal side thereof over the open end and sealable panel portions of said bag, said hood and base defining a vacuum chamber therebetween adapted to receive the open end of said bag in exposed relationship therein, said vacuum chamber comprising trough means defined on said base for collecting liquids and particles therein during vacuum sealing of said bag, static seal means circumventing said vacuum chamber and disposed between said base and said hood for directly engaging outer surfaces of the sealable panel portions of said bag in response to movement of said hood to its closed position to form a static seal isolating the open end of said bag and said vacuum chamber from ambient and to maintain the open end of said bag in communication with the evacuative chamber thereof, evacuation means communicating with said vacuum chamber for selectively evacuating said vacuum chamber and the evacuative chamber of said bag, and heat sealing means, including a heating element mounted forwardly on one of said base and said hood, for selectively forming an air-tight heat seal across the sealable panel portions of said bag to maintain said vacuum within the evacuative chamber of said bag.

35. An apparatus for vacuum sealing a plastic bag having overlying first and second panels defining an evacuative chamber and overlying heat sealable panel portions terminating at an open end of said bag communicating with said evacuative chamber, said apparatus comprising a base defining an upper support surface adapted to receive the open end and sealable panel portions of said bag thereon, a hood mounted on said base and movable to a closed position to position a frontal side thereof over the open end and sealable panel portions of said bag, said hood and base defining a vacuum chamber therebetween adapted to receive the open end of said bag in exposed relationship therein, static seal means circumventing said vacuum chamber and disposed between said base and said hood for directly engaging outer surfaces of the sealable panel portions of said bag in response to movement of said hood to its closed position to form a static seal isolating the open end of said bag and said vacuum chamber from ambient and to maintain the open end of said bag in communication with the evacuative chamber thereof, evacuation means communicating with said vacuum chamber for selectively evacuating said vacuum chamber and the evacuative chamber of said bag, said evacuation means comprising vacuum pump means for selectively drawing a vacuum in said vacuum chamber, tube means for communicating said vacuum pump means with said vacuum chamber and control means for activating said vacuum pump means in response to movement of said hood to its closed position on said base, said control means comprises a normally open switch mounted on said base and a pin means secured on an underside of said cover for engaging and closing said switch when said hod is moved to its closed position on said base, heat sealing means, including a heating element mounted forwardly on one of said base and said hood, for selectively forming an air-tight heat seal across the sealable panel portions of said bag to maintain said vacuum within the evacuative chamber of said bag, and vent means for normally venting said vacuum chamber to ambient and closing means for selectively closing said vent means to isolate said vacuum chamber from ambient.

36. An apparatus for vacuum sealing a plastic bag having overlying first and second panels defining an evacuative chamber and overlying heat sealable panel portions terminating at an open end of said bag communicating with said evacuative chamber, said apparatus comprising a base defining an upper support surface adapted to receive the open end and sealable panel portions of said bag thereon, a hood mounted on said base and movable to a closed position to position a frontal side thereof over the open end and sealable panel portions of said bag, said hood and base defining a vacuum chamber therebetween adapted to receive the open end of said bag in exposed relationship therein, static seal means circumventing said vacuum chamber and disposed between said base and said hood for directly engaging outer surfaces of the sealable panel portions of said bag in response to movement of said hood to its closed position to form a static seal isolating the open end of said bag and said vacuum chamber from ambient and to maintain the open end of said bag in communication with the evacuative chamber thereof, evacuation means communicating with said vacuum chamber for selectively evacuating said vacuum chamber and the evacuative chamber of said bag, heat sealing means, including a heating element mounted forwardly on one of said base and said hood, for selectively forming an air-tight heat seal across the sealable panel portions of said bag to maintain said vacuum within the evacuative chamber of said bag, said heat sealing means further comprising an electrical power source and switch means for selectively connecting said power source to said heating element, said switch means comprising a normally open switch mounted on said base and means mounted on said hood for closing said switch means when said hood is in its closed position on said base, and vent means for normally venting said vacuum chamber to ambient and closing means for selectively closing said vent means to isolate said vacuum chamber from ambient.

37. An apparatus for vacuum sealing a plastic bag having overlying first and second panels defining an evacuative chamber and overlying heat sealable panel portions terminating at an open end of said bag communicating with said evacuative chamber, said apparatus comprising a base defining an upper support surface adapted to receive the open end and sealable panel portions of said bag thereon, a hood mounted on said base and movable to a closed position to position a frontal side thereof over the open end and sealable panel portions of said bag, said hood and base defining a vacuum chamber therebetween adapted to receive the open end of said bag in exposed relationship therein, static seal means circumventing said vacuum chamber and disposed between said base and said hood for directly engaging outer surfaces of the sealable panel portions of said bag in response to movement of said hood to its closed position to form a static seal isolating the open end of said bag and said vacuum chamber from ambient and to maintain the open end of said bag in communication with the evacuative chamber thereof, evacuation means communicating with said vacuum chamber for selectively evacuating said vacuum chamber and the evacuative chamber of said bag, heat sealing means, including a heating element mounted forwardly on one of said base and said hood, for selectively forming an air-tight heat seal across the sealable panel portions of said bag to maintain said vacuum within the evacuative chamber of said bag, and lid attachment means for attachment to a container, and connection means interconnected between the vacuum chamber of said apparatus and said lid attachment for selectively drawing a vacuum through said lid attachment and from within said container in response to activation of said evacuation means, said lid attachment means comprising a lid adapter having a passage formed therethrough and first sealing means secured thereunder for forming a static seal when it is mounted on said container, a connector, second sealing means for forming a static seal between said lid adapter and said connector when said connector is mounted on said lid adapter, and means mounted on said lid adapter for movement between a first position openly communicating said passage with said container, a second position for forming a third sealing means closing said passage to seal said container and a third position for opening said passage to communicate said container with ambient to release the vacuum therein.

38. An apparatus for vacuum sealing a plastic bag having overlying first and second panels defining an evacuative chamber and overlying heat sealable panel portions terminating at an open end of said bag communicating with said evacuative chamber, said apparatus comprising a hood movable to a closed position on a support surface to position a frontal side thereof over the open end and sealable panel portions of said bag, said hood defining a vacuum chamber therein adapted to receive the open end of said bag in exposed relationship therein, static seal means mounted beneath said hood and circumventing said vacuum chamber for directly engaging outer surfaces of the sealable panel portions of said bag in response to movement of said hood to its closed position to form a static seal isolating the open end of said bag and said vacuum chamber from ambient and to maintain the open end of said bag in communication with the evacuative chamber thereof, evacuation means communicating with said vacuum chamber for selectively evacuating said vacuum chamber and the evacuative chamber of said bag, said evacuation means comprising a tube having its distal end mounted in said hood in communication with said vacuum chamber, and heat sealing means, including a heating element mounted forwardly on and beneath said hood, for, selectively forming an air-tight heat seal across the sealable panel portions of said bag to maintain said vacuum within the evacuative chamber of said bag.

* * * * *

UNITED STATES PATENT AND TRADEMARK OFFICE

CERTIFICATE OF CORRECTION

PATENT NO. : 4,941,310

DATED : July 17, 1990

INVENTOR(S) : Hanns J. Kristen

It is certified that error appears in the above-identified patent and that said Letters Patent is hereby corrected as shown below:

Column 6, line 53, after "secured" insert -- on an --.

IN THE CLAIMS:

Column 13, line 18 (of Claim 35), change "hod" to -- hood --.

Signed and Sealed this

Thirty-first Day of December, 1991

*Attest:*

HARRY F. MANBECK, JR.

*Attesting Officer*

*Commissioner of Patents and Trademarks*